US005816429A

United States Patent [19]

Kobayashi

[11] Patent Number: 5,816,429

[45] Date of Patent: Oct. 6, 1998

[54] CONTAINER OPENING DEVICE

[76] Inventor: Tadao Kobayashi, 9-11, Higashiikuta 1-chome, Tama-Ku, Kawasaki, Kanagawa, Japan

[21] Appl. No.: 861,803

[22] Filed: May 22, 1997

[30] Foreign Application Priority Data

Dec. 24, 1996 [JP] Japan ..... 8-343618

[51] Int. Cl.[6] ..... B65D 17/353

[52] U.S. Cl. ..... 220/270; 220/273

[58] Field of Search ..... 220/265, 266, 220/268, 269, 270, 272, 273, 906

[56] References Cited

U.S. PATENT DOCUMENTS

| | | | |
|---|---|---|---|
| 3,406,866 | 10/1968 | Jasper | 220/270 |
| 3,576,272 | 4/1971 | Colby | 220/270 |
| 3,735,892 | 5/1973 | Kinkel | 220/273 |
| 3,768,692 | 10/1973 | Saunders | 220/273 |
| 3,863,801 | 2/1975 | Pillnik | 220/270 X |
| 5,007,554 | 4/1991 | Hannon et al. | 220/273 X |
| 5,655,678 | 8/1997 | Kobayashi . | |

FOREIGN PATENT DOCUMENTS 47-6744 4/1972 Japan .

*Primary Examiner*—Allan N. Shoap
*Assistant Examiner*—Nathan Newhouse
*Attorney, Agent, or Firm*—Oblon, Spivak, McClelland, Maier & Neustadt, P. C.

[57] ABSTRACT

An upper panel has a shearing line including a shear-start portion, linear portions extending from opposite ends of the shear-start portion in an equal length, and an arced portion connecting leading edges of the linear portion. The upper panel also has foldable lines and ribs on the upper panel, each of the foldable lines being located at a position inner to and in parallel to each of the linear portions, and each of the ribs extending in parallel with each of the foldable lines. A pull tab has a fixing portion fixed to a portion of the upper panel inner to the shear-start portion. The pull tab has a pressing portion extending out the shearing line so as to press a portion of the upper panel located outside of the shear-start portion when a raising portion of the pull tab is raised. When the pull tab is raised for opening operation, each of the linear portions of a part detached from the upper panel has a sheared edge curled toward the inside of a container, providing safety.

5 Claims, 5 Drawing Sheets

CONTAINER OPENING DEVICE

BACKGROUND OF THE INVENTION

1. Field of the Invention

The present invention relates to a container opening device, in particular, a container opening device which can open a container such as a can by raising a pull tab fixed to an upper panel of the container, shearing a detachable part surrounded by a shearing line formed on the upper panel along the shearing line, and cutting off the detachable part from the remaining part of the upper panel.

2. Discussion of Background

In FIG. 7, there is shown a conventional full open type container opening device which can open a container by raising and pulling a pull tab 20 fixed to an upper panel 10 of the container, shearing a detachable part 10*a* surrounded by a shearing line 30 formed on the upper panel along the shearing line 30, and cutting off the detachable part from the remaining part 10*b* of the upper panel.

As shown in this figure, the shearing line 30 is circularly formed on the upper panel 10 at a position nearest to an outer periphery of the upper panel, the pull tab 20 is fixed to the upper panel inside the shearing line 30 by a rivet 10*c*, and the pull tab 20 has a pressing portion 20*b* provided thereon so as to press a portion of the upper panel nearest to and inside the shearing line.

In opening the container, a raising portion 20*a* of the pull tab is raised, the portion of the upper panel 20 nearest to the shearing line 30 is pushed down by the pressing portion 20*b* to start shearing, and then the pull tab 20 is raised. Such a shape of the shearing line 30 and the pressing position of the pull tab 20 can cause the shearing location of the shearing line to shift from a shear-start position to right and left directions, and to upwardly cut off a portion of the detachable part 10*a* of the upper panel from the remaining part 10*b* of the upper panel. In addition, by pulling the pull tab 20, shearing is carried out along the entire unsheared portion of the shearing line to cut off the entire detachable part 10*a* of the upper panel from the remaining part 10*b* while the shear-start portion of the detachable part 10*a* of the upper panel is bent down into the container.

In order to facilitate raising and pulling the pull tab after starting shearing, auxiliary shearing lines 40 may be provided in the vicinity of the fixing member 10*c* of the pull tab.

Firstly, not only engaging a fingertip with the pull tab is difficult but also raising the pull tab with the engaged fingertip needs an extremely large force in initial raise of the pull tab because the pull tab is in close touch with the upper panel before opening the container.

Although a projection or a recess is formed at a portion of the upper panel corresponding to the raising portion so as to facilitate engaging a finger with the raising portion, firm fixing of the pull tab still necessitates a large force to raise the pull tab with the engaged fingertip, which means that it is difficult for in particular a sickly person or an elderly person to open the container.

Second, the remaining part of the upper panel applies a large pulling force to the detachable part of the upper panel to necessitate application of a quite large raising force to the pull tab to smoothly shift shearing from the shear-start position in the right and left directions along the shearing line, i.e. to smoothly shear the detachable part because the shearing line is circular.

As a result, the forces applied in the raising direction and the pulling direction become excessive, and the detachable part of the upper panel which has been retained by the holding force from the remaining part of the upper panel so far is abruptly released to rebound the detached part of the upper panel toward the finger applying the forces, assisted by an elastic restoring force of the upper panel.

In the conventional pull tab, the pressing portion exists inside the shearing line, and a rough and sharp edge is formed on the periphery of the detached portion after having sheared the detached portion along the shearing line. When the shear-start portion and the opposite sides of the rebounded detached part get in strong contact with a finger just after completion of opening the container, the detached part could hurt the finger to cause bleeding. The danger of such hurt is not recommendable to the container opening device for a container with food or drink stored therein.

In JP-A-476744 has been disclosed a container opening device which can decrease forces required in starting shearing and in raising a pull tab after that. The container opening device has a shearing line 30 shaped in an angled form or wedgy form having a shear-start portion 30*a* located as an apex and linear portions 30*b* extending from the apex in the right and left directions as shown in FIG. 8. However, the prior art still requires a large raising force in initial raise of a pull tab 20. In addition, the danger of hurt after opening a container is not wiped away since the pull tab is attached to have a pressing portion 20*b* existing inside the shearing line, and rough and sharp edges are formed on the shear-start portion and the linear portions of a detachable part 10*a* of an upper panel after the detachable part has been cut off from the remaining part 10*b*.

It is an object of the present invention to solve the problems of the conventional container opening devices, and to eliminate a danger of hurt by a part detached from the remaining part of an upper panel on completion of container opening by preventing sharp edges from being formed on at least linear portions on right and left sides of a shear-start position on the detached part by raising a pull tab.

It is another object of the present invention to minimize a raising force required for an initial raise of the pull tab.

It is a further object of the present invention to improve the stability of a pressing portion to a fixing portion in a swingable direction in raising the pull tab to ensure safe and easy opening.

According to a first aspect of the present invention, there is provided a container opening device which comprises an upper panel and a pull tab; the upper panel having a shearing line including a shear-start portion, linear portions extending from opposite ends of the shear-start portion in an equal length, and an arced portion connecting leading edges of the linear portions so as to provide a detachable portion surrounded by the shearing line; foldable lines formed on the detachable portion, each being located at a position inner to and in parallel to each of the linear portions; ribs formed on the detachable portion, each extending at a position near to and in parallel to each of the foldable lines; the pull tab having one end formed with a raising portion, the other end formed with a pressing portion and an intermediate portion formed with a fixing portion; the fixing portion fixed to the detachable portion of the upper panel at a position inner to the shear-start portion; and the pressing portion extending out of the shearing line so as to press a portion of a remaining portion of the upper panel located outside of the shear-start portion when the raising portion is raised.

By such an arrangement, when the pull tab is raised, the fixing portion of the pull tab applies an upward pulling force to a portion inside the shear-start portion of the shearing line because the pressing portion presses a portion of the remaining part outside the shearing line on the upper panel. The upward pulling force starts to shear the shearing line at the shear-start portion. When the pull tab is further raised and pulled, the shearing line is sheared along the linear portions. Although the detachable part of the upper panel at the linear portion is successively subjected to holding force at that time, the linear portions has edges downwardly-curled just after shearing because the foldable lines and the ribs are provided inside the linear portions. On the other hand, the pull tab covers the shear-start portion of the part detached from the upper panel. As a result, even if the part detached from the upper panel rebounds toward a finger due to reaction on completion of opening to get in touch with the finger and so on, there is no danger of hurt.

In accordance with the first aspect of the present invention, when the pull tab is raised, shearing starts at the shear-start portion of the shearing line with a small force under a principle of a lever with the raising portion, the pressing portion and the fixing portion served as an input point, a fulcrum and an output point, respectively. As the pull tab is further raised, shearing of the shearing line shifts from the shear-start portion to the linear portions. At that time, the pulling force applied from the pull tab is centered on portions where shearing is now going on. The linear portions of the detachable start are downwardly curled along the foldable lines just after having been detached from the remaining part of the upper panel because the foldable lines and ribs are provided on the detachable part inside the linear portions. On the other hand, the shear-start portion of the detachable part is covered by the pull tab.

In contrast with the prior art, there is no possibility that an edge of the detached part can hurt a finger holding the pull tab during opening operation. Safety is improved during opening operation.

It is preferable that the shear-start portion of the shearing line is formed at a position near to a portion of an outer periphery of the upper panel, the linear portions extend from the opposite ends of the shear-start portion to positions nearest to other portions of the outer periphery of the upper panel, and the arced portion extends along the outer periphery of the upper panel at a position nearest to the remaining portion of the outer periphery.

By such an arrangement, an opening is formed as soon as possible after the opening operation, facilitating takeout of food and drink.

According to this mode, it is possible to maximize the area of the opening. This mode is appropriate to a full open type of container opening device, which can facilitate takeout of the content in the container.

According to a second aspect of the present invention, there is provided a container opening device wherein the fixing portion of the pull tab is formed in a tongue shape which is defined by a cut or a notch in a substantially U-character shape so as to extend from the pressing portion of the pull tab in a direction toward the raising portion, the fixing portion having a base end formed with a bend-supporting portion; and the bend-supporting portion providing a space for insertion of a finger between the upper panel and the raising portion of the pull tab, which is upwardly bent and up raised by a initial raising force applied to the raising portion; wherein when a raising force is applied to the raising portion subsequently to the initial raising force, the subsequent raising force is amplified to a large pulling force under a principle of a lever with the raising portion, the pressing portion for pressing the upper panel and the fixing portion served respectively as an input point, a fulcrum and an output point so that the pulling force is transmitted from the fixing portion to a position inner to the shear-start portion of the detachable portion of the upper panel.

By such an arrangement, it is possible to easily carry out an initial raise of the pull tab with a small force.

According to the second aspect, the raising force applied to the raising portion up raises the bend-supporting portion to provide a space between the pull tab and the upper panel for easy engagement of a fingertip with the pull tab, minimizing a force required for the initial raise of the pull tab. This can prevent the fingertip from being hurt or a fingernail tip from being chipped. During subsequently raising the pull tab, opening operation can be done with a small force because the raising force is amplified under the principle of the lever with the raising portion, the pressing portion and the fixing portion served respectively as an input point, a fulcrum and an output point, and is transmitted to a position inner to the shear-start portion of the detachable portion of the upper panel as a large pulling force.

According to a third aspect of the present invention, there is provided a container opening device wherein the pull tab has a projection formed thereon between the pressing portion and the bend-supporting portion of the pull tab so as to downwardly project and to get in close touch with the bend-supporting portion, which is upraised by raising the pull tab.

By such an arrangement, the projection can get in close touch with the upraised bend-supporting portion in raising the pull tab to improve the stability of the pressing portion with respect to the fixing portion in a swingable direction in subsequent operation.

According to the third aspect of the present invention, the mechanical strength of the bend-supporting portion is enhanced by the projection after having initially raised the pull tab. The stability of the pressing portion with respect to the fixing portion in a swingable direction can be increased in subsequent raising operation to ensure safe and easy opening operation.

It is preferable that a notch is formed between the shear-start portion and each of the linear portions of the shearing line so as to reach a start-end of each of the foldable lines.

The provision of the notch can smoothly and easily start bending the linear portions of the shearing line in raising the tab.

By this mode, portions of the detachable part between the linear portions of the shearing line and the ribs can start bending along the foldable lines in a smooth and easy manner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Now, preferred embodiments according to the present invention will be described in reference to embodiments shown in the accompanying drawings.

Figure 1:
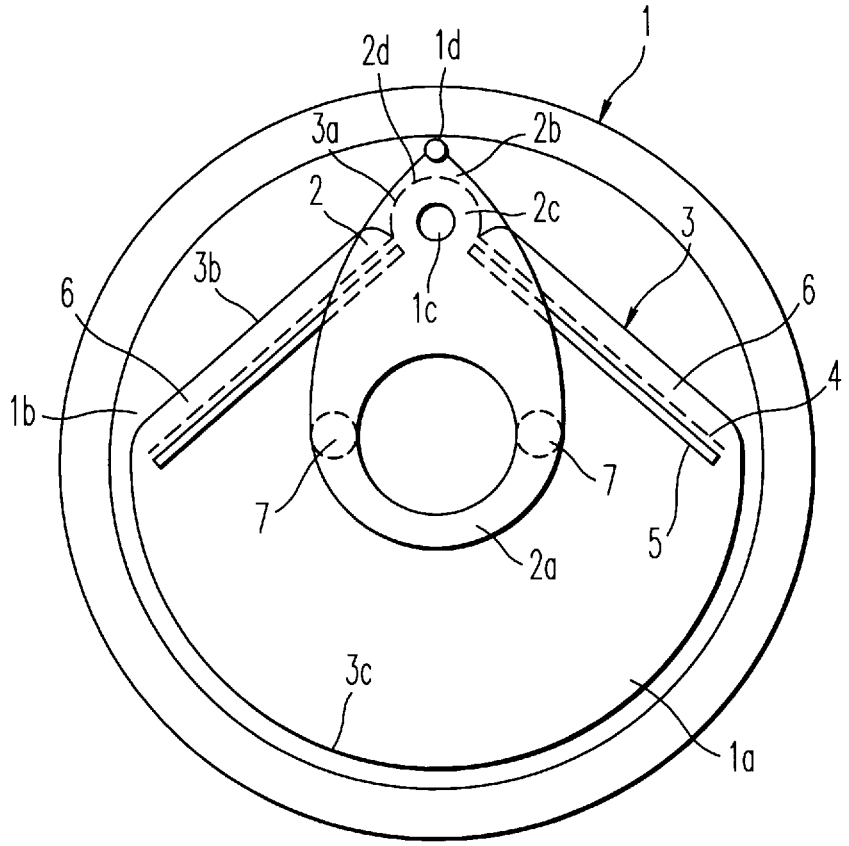
FIG. 1 is a plan view of the container opening device according to a first embodiment of the present invention.
Figure 2:
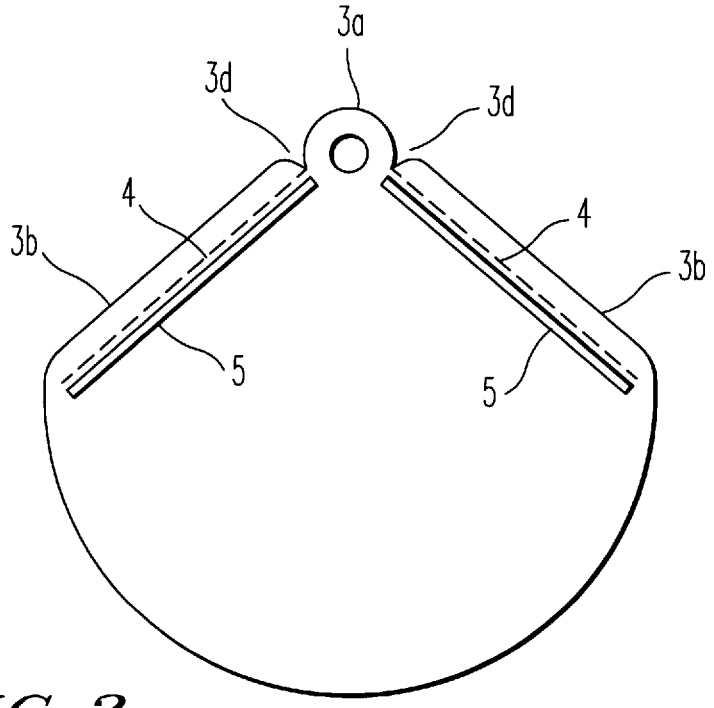
FIG. 2 is a plan view showing only the detachable part shown in FIG. 1.

In FIG. 1, there is shown a plan view of a first embodiment according to the present invention. In FIG. 2, there is shown a plan view of only a detachable part shown in FIG. 1. A container opening device according to the present invention is constituted by an upper panel 1 and a pull tab 2 fixed to the upper panel as shown in FIG. 1.

The upper panel 1 is joined to an upper end of a container such as a can by a known method, e.g. seaming. Although the plane shape of the upper panel 1 is circular in the shown embodiment, there is no limitation on the plane shape.

The upper panel 1 includes a part 1*a* surrounded by a shearing line 3 and detachable from the upper panel, and a remaining part 1*b* located outside the shearing line and remaining in the container even after completion of opening operation. The shearing line 3 is also called a score line or a weakened line. The shearing line is a thin walled line so that it can be easily sheared when an external force is applied to the part 1*a* detachable from the pull tab 2 explained later on. The area ratio of the detachable part 1*a* to the remaining part 1*b*, i.e. the open area rate is irrelevant in the present invention.

The shearing line 3 includes a shear-start portion 3*a* located in the vicinity of an outer periphery of the upper panel, linear portions 3*b* extending from opposite ends of the shear-start portion in an equal length, and an arced portion 3*c* extending from leading edges of the linear portions along and in the vicinity of the outer periphery of the upper panel and connecting the leading edges of the linear portions. The shear-start portion 3*a* and the linear portions 3*b* are formed in an angled or wedged shape with the shear-start portion located at the apex.

The detachable part 1*a* of the upper panel has foldable lines 4 formed thereon so that the respective foldable lines extend in parallel with the respective linear portions 3*b* at positions inner to the respective linear portions of the shearing line by about 1–2 mm. The foldable lines 4 are thin walled lines like the shearing line 3 so that portions of the detachable part adjacent to the respective linear portions 3*b* can be easily curled toward the inside of the container when an external force is applied to the part 1*a* detachable from the pull tab 2 in a direction for separating the detachable part from the remaining part 1*b*.

The detachable part also has ribs 5 formed thereon to extend in parallel with the respective linear portions 3*b* at positions inner to and near to the respective foldable lines 4. The reason why the ribs 5 are provided is that portions of the detachable part inner to the foldable lines have strength resistant to an external force to ensure bending at the foldable lines 4 when the external force is applied to the portions of the detachable part inner to the respective linear portions so as to be upwardly separated from the remaining part 1*b* of the upper panel. There is no limitation on the shape of the ribs as long as the portions of the detachable part inner to the respective foldable lines have slightly greater strength than the other portions of the upper panel 1. Although the word "ribs" means measures for assisting ensured curling along the foldable lines in the specification, the scope of the invention is not limited to the ribs.

The pull tab 2 has one end formed with a pressing portion 2*b*, the other end formed with a raising portion 2*a* and an intermediate portion formed with a fixing portion 2*c* like the conventional ones. The raising portion 2*a* has a finger hole formed therein. In accordance with the present invention, the pull tab 2 has the fixing portion 2*c* fixed to a portion of the detachable part inner to the shear-start portion 3*a* of the shearing line 3, i.e. a portion corresponding to the apex of the angled or wedged shape by means of e.g. a rivet 1*c* like the conventional devices. The pressing portion 2*b* extends to the remaining part 1*b* , of the upper panel over the shear-start portion 3*a*.

The pull tab 2 according to the present invention is identical to the conventional ones in that the outer periphery of the pull tab 2 and the inner periphery of the finger hole in the raising portion 2*a* have required strength, and that the peripheries are curled to prevent a fingertip from being injured. The pull tab according to the present invention offers an advantage in that it is easy to push a fingertip into a space between the raising portion 2*a* of the pull tab and an upper surface of the upper panel 1 so as to raise the pull tab 2 since the pull tab floats above the upper surface of the upper panel by the upward projection of the ribs 5 from the upper panel 1 in such a state that the pull tab is fixed to the upper panel.

Figure 3:
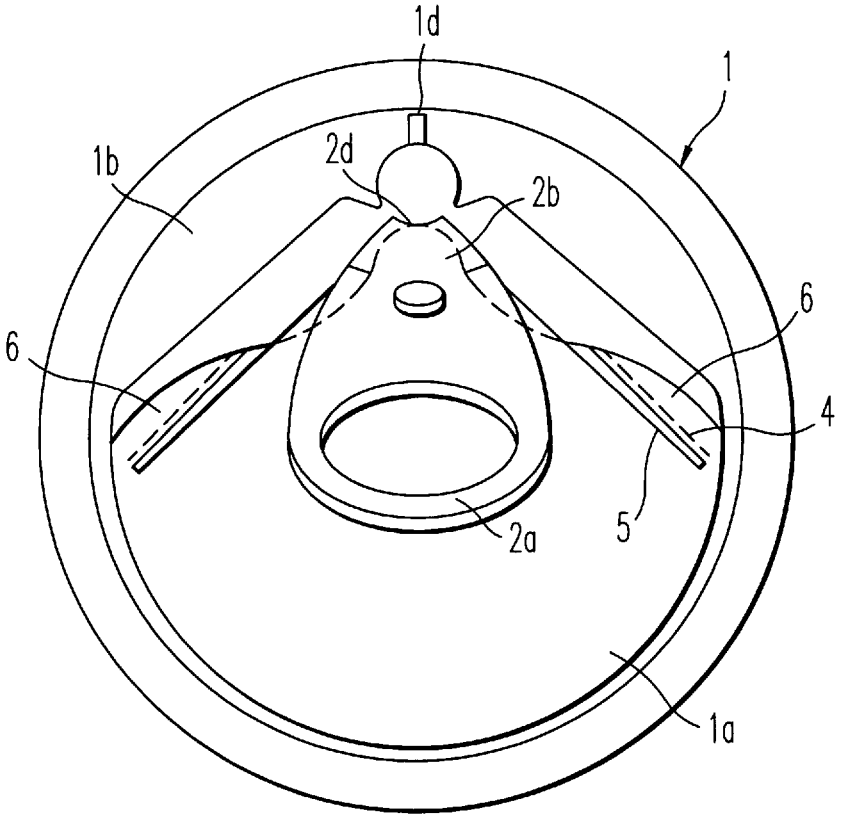
FIG. 3 is a plan view showing a state wherein the device is on opening operation.

By such arrangement, when a fingertip is engaged with the raising portion 2*a* of the pull tab 2 to raise the pull tab for opening operation, the pressing portion 2*b* of the pull tab 2 presses a portion of the remaining part 1*b* outside the shear-start portion 3*a* of the shearing line 3. The pull tab with the raising force applied thereto amplifies the raising force to upwardly apply a large pulling force from the fixing portion 2*c* to the portion of the detachable part inner to the shear-start portion 3*a* under the principle of the lever with the raising portion 2*a*, the pressing portion 2*b* and the fixing portion 2*c* (the rivet 1*c*) served respectively as an input point, a fulcrum and an output point. As a result, the shearing line 3 starts shearing at the shear-start portion 3*a*. A raising force or pulling-up force subsequently applied to the pull tab gives a force to the detachable part 1*a* of the upper panel in a direction for separating the detachable part from the remaining part 1*b*. As a result, the shearing location at the shearing line shifts from the shear-start portion 3*a* to both linear portions 3*b*, and the shearing line is sheared along the linear portions. At that time, portions 6 of the detachable part which are located between the respective linear portions 3*b* and the respective ribs 5 just after having been sheared are curled along the foldable lines 4 toward the inside of the container as shown in FIG. 3 because the portions of the detachable part which has been just separated from the remaining part are subjected to the greatest holding force, and because the foldable lines 4 and the ribs 5 are provided on the detachable part inside the linear portions 3*b*.

As the shearing locations of the shearing line shift from the shear-start portion 3*a* toward the arced portion 3*c* along the linear portions 3*b*, the linear portions 3*b* are curled towards the inside of the container throughout the length thereof.

It is preferable that the shearing line 3 has notches 3*d* formed therein between the shear-start portion 3*a* and each of the linear portions 3*b* to extend to the beginning of the respective foldable lines 4 as clearly shown in FIG. 2. The provision of the notches offers an advantage in that the raising of the pull tab makes easy and smooth bending start along the foldable lines 4 of the portions 6 between the respective linear portions 3*b* and the respective ribs 5, following separation of the shear-start portion 3*a*.

When the pull tab is pulled toward a direction toward the arced portion, the shearing line including the arced portion 3*c* is totally cut to separate the detachable part 1*a* with the pull tab from the remaining part 1*b*.

Figure 4:
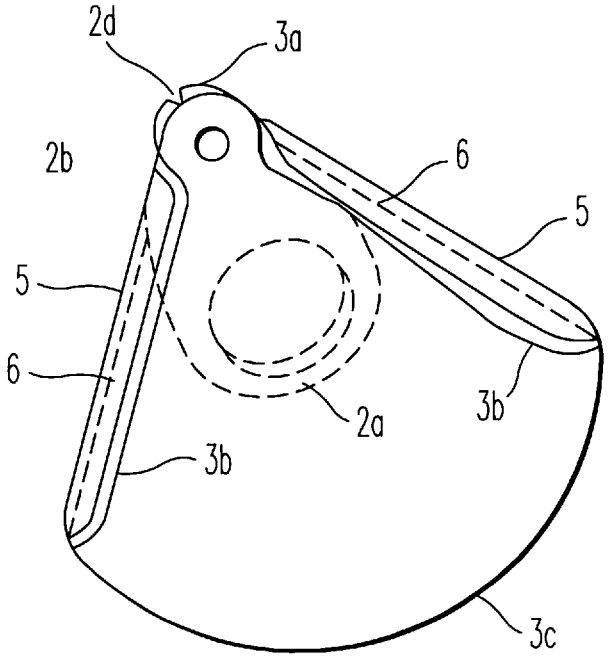
FIG. 4 is a perspective view showing the inner side of a part detached from an upper panel.

In FIG. 4, there is shown a perspective view of the inner side of the detached part 1*a* which has been separated from the remaining part 1*b*. In the container opening device according to the present invention, the shear-start portion 3*a* of the detachable part 1*a* which has been separated from the upper panel 1 of the container by the pull tab 2 has a sharp edge formed thereon in shearing as shown. However, the container opening device can eliminate the danger of injuring a hand or a finger by contact with the edges of the shear-start portion 3*a* or the linear portions 3*b* because the edge of the shear-start portion is covered by the pressing portion 2*b* of the pull tab 2, and because the linear portions 3*b* which are not covered by the pull tab and have sharp edges formed thereon in shearing are curled toward the inside of the container.

When the remaining part 1*b* of the upper panel has a rib 1*d* provided thereon on an imaginary line connecting between the rivet 1*c* and the leading edge of the pressing portion 2*b* of the pull tab, and the leading edge of the pressing portion is formed with a recess 2*d* corresponding to the rib as shown in FIGS. 1 and 3, the recess 2*d* slides guided by the rib 1*d* in raising the pull tab, further improving the stability of the raising operation.

As an alternative, the leading edge of the pressing portion 2*b* may be formed with a convex, and the remaining part 1*b* of the upper plate is formed with a groove for guiding the convex. High stability can be offered in that case as well.

In the first embodiment, it is easy to raise the pull tab 2 by engagement of a fingertip with the raising portion since the pull tab 2 floats above the upper surface of the upper panel 1 because of the ribs 5 formed on the upper panel. However, on the other hand, when a downward force is applied to the raising portion of the pull tab for some reason, there is a danger of inadvertent opening because the ribs 5 serve as fulcrums to apply an upward pulling force to the shear-start portion of the shearing line by the fixing portion 2*c*. In order to avoid the danger, it is preferable that projections 7 are provided on the upper surface of the detachable part 1*a* of the upper panel 1 so as to contact with a lower surface of the raising portion 2*a* at opposite ends in the right and left direction.

If the pull tab 2 of FIG. 1 has great stiffness, there is possibility that it is difficult for in particular a sickly person or an elderly person to open the container because a large force is required for an initial raise.

Figure 5:
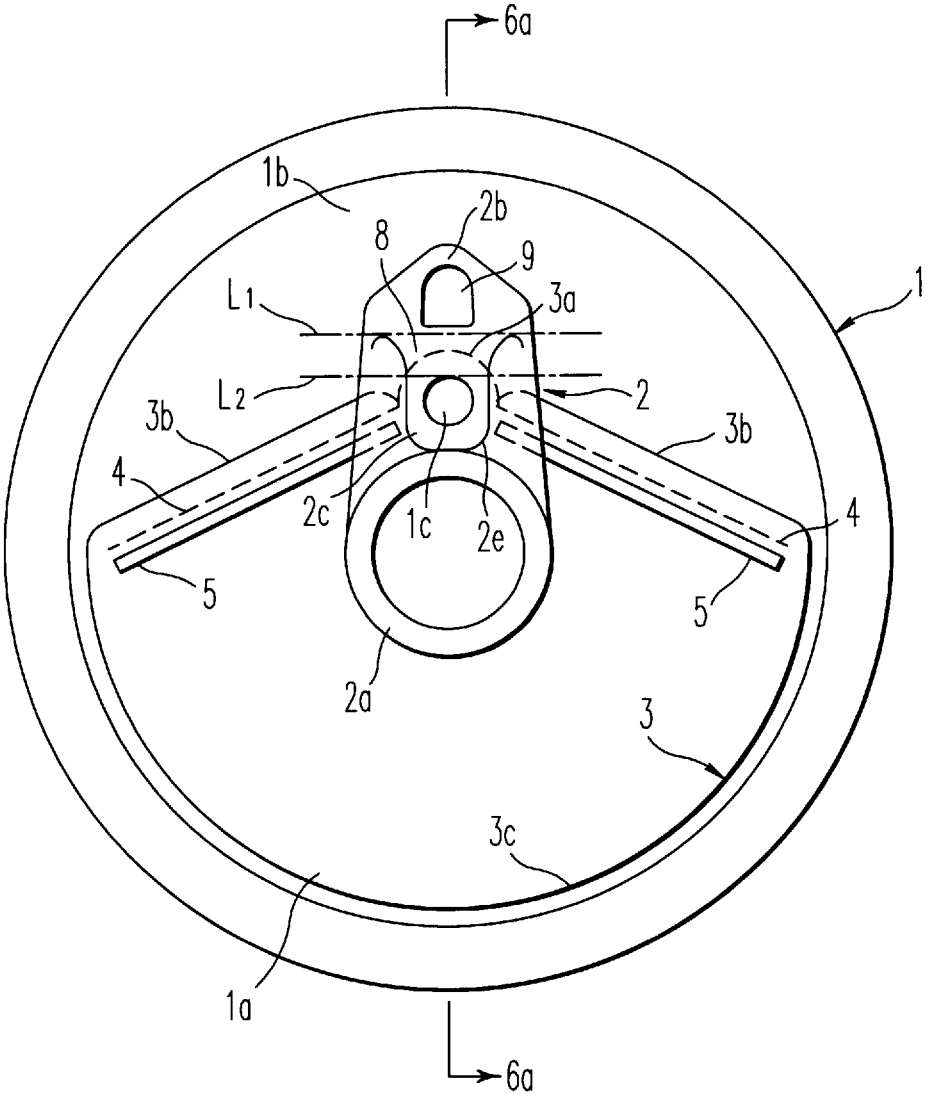
FIG. 5 is a plan view of the container opening device according to a second embodiment of the present invention.
Figure 6A:
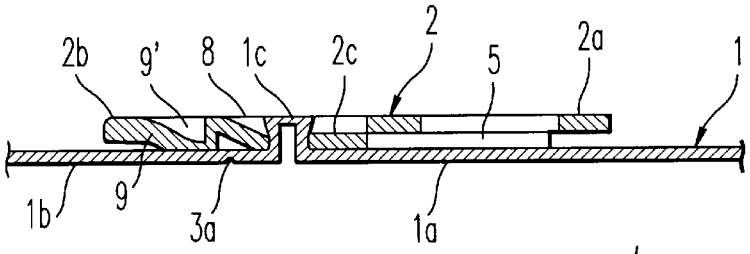
FIGS. 6(*a*)–(*d*) are cross-sectional views explaining the operation of the device.
Figure 6B:
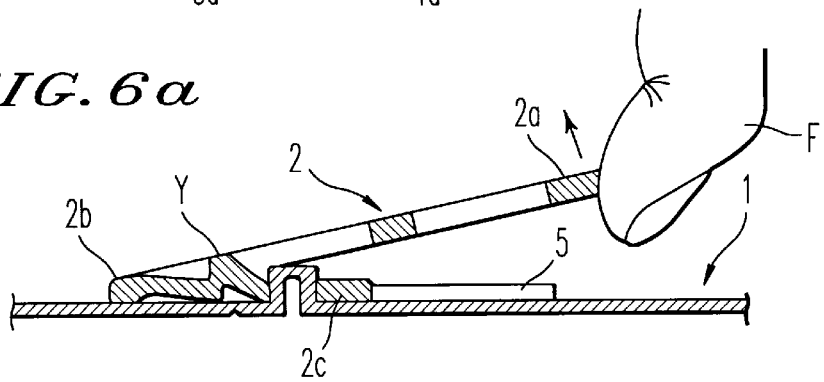
Figure 6C:
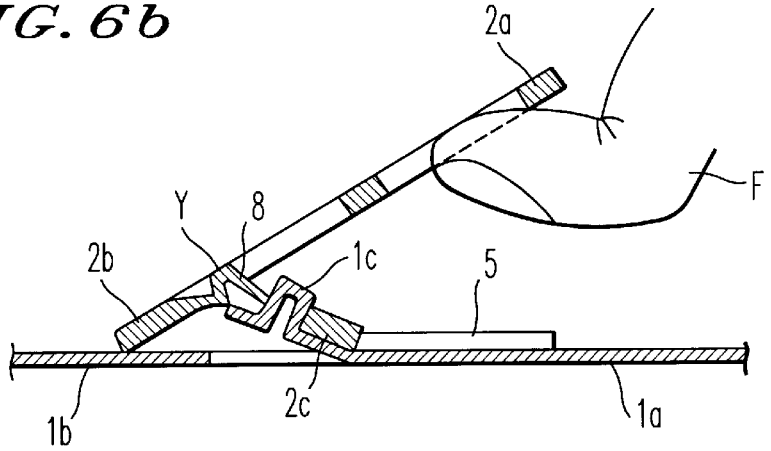
Figure 6D:
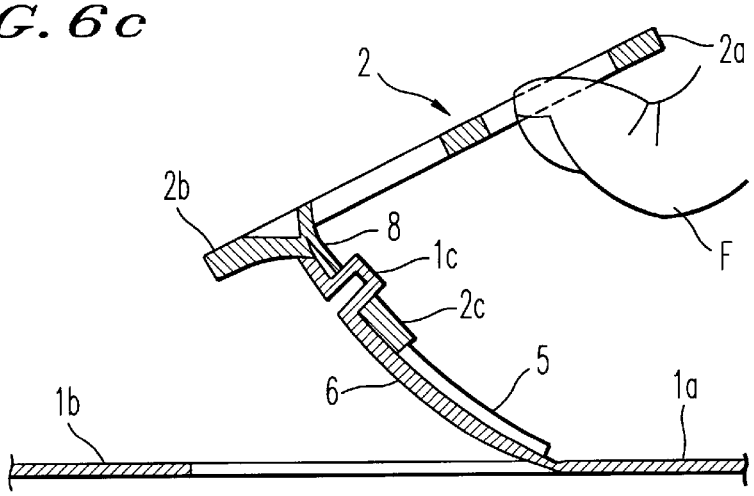
Figure 7:
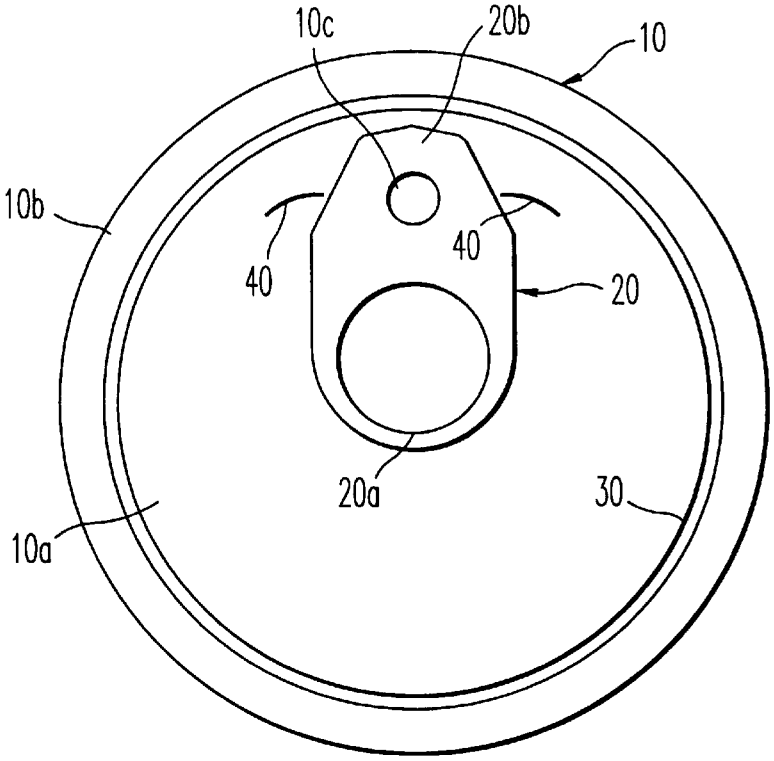
FIG. 7 PRIOR ART
FIG. 7 is a plan view of a conventional container opening device.
Figure 8:
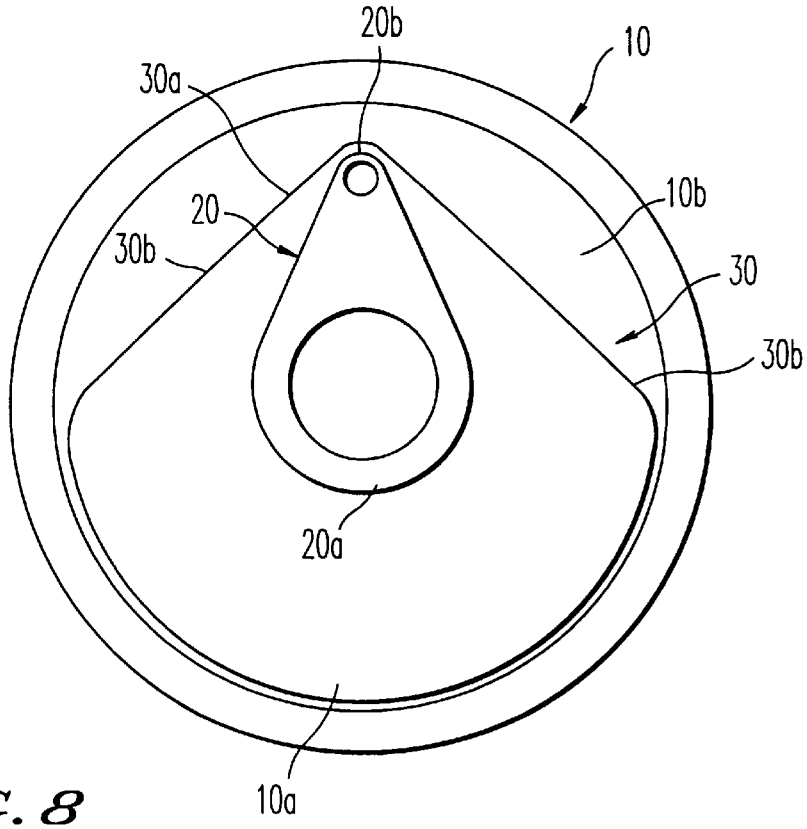
FIG. 8 PRIOR ART
FIG. 8 is a plan view of another conventional container opening device.

In FIG. 5, there is shown another embodiment wherein improvements are made to reduce the force required for the initial raise. The upper panel 1 has the same structure as the one according to the previous embodiment.

This embodiment is different from the first embodiment in terms of the structure of the full tab 2. Specifically, the fixing portion 2*c* is formed in a tongue shape extending toward the raising portion 2*a* from the pressing portion 2*b* by providing a cut 2*e* or a notch formed substantially in a U-character shape in the pull tab 2. The fixing portion is offset toward the raising portion 2*a* in comparison with an imaginary line L1 connecting opposite base ends of the cut 2*e* or the notch on the side of the pressing portion 2*b*. A bend-supporting portion 8 is provided at a portion between the line L1 at the end of the fixing portion on the side of the pressing portion 2*b*, and an imaginary line L2 passing on the end of the rivet 1*c* on the side of the pressing portion 2*b* and in parallel with the line L1.

In FIGS. 6(*a*)–(*d*), there are shown cross-sectional views taken along the line X—X of the FIG. 5, explaining the processes from no application of a raising force to the pull tab 2 to application of the raising force for opening.

When no external force is applied to the pull tab 2, the pull tab 2 floats above the upper surface of the detachable part 1*a* of the upper panel by the projection height of the ribs 5 as shown in FIG. 6(*a*). At that time, the bend-supporting portion 8 is almost flat and is not upraised.

The provision of the bend-supporting portion 8 between the two lines L1 and L2 offers the following advantages when a fingertip F is engaged with the raising portion 2*a* for raising operation:

When the fingertip F is put against the leading end of the raising portion 2*a* of the pull tab 2 to apply a small upward force to the leading end of the raising portion as if the fingertip is inserted into a space between the raising portion and the upper plate 1 as shown in FIG. 6(*b*), the application direction of the upward force is reversed serving the line L1 connecting the opposite ends of the cut 2*e* or the notch as a fulcrum, and the leading edge of the pressing portion 2*b* presses down the remaining part 1*b* of the upper panel because the leading edge of the pressing portion 2*b* gets or is already in touch with the upper surface of the remaining part 1*b* of the upper panel 1. At that time, the leading edge of the pressing portion 2*b* is reacted by the upper panel 1 since the pressing force is too small to shear the shear-start portion 3*b* of the shearing line.

A raising force subsequently applied to the raising portion 2*a* and the reaction from the pressing portion 2*b* gradually bends the bend-supporting portion 8 downwardly along the line L1 and upwardly along the line L2 until the bend-supporting portion is upraised. As a result, the raising portion 2*a* can be raised with a small force in initial raising operation of the pull tab as shown in FIG. 6(*b*) to easily form a sufficient gap for insertion of the fingertip between the raising portion 2*a* and the upper panel 1.

The up raised bend-supporting portion 8 has an upper end forming a fulcrum Y between the raising portion 2*a* and the pressing portion 2*b*.

When the fingertip F is subsequently inserted into the finger hole in the pull tab to apply a further raising force to the raising portion 2*a*, the raising force applied to the raising portion 2*a* is amplified to press a portion of the remaining part 1*b* of the upper panel outside the shearing line by the leading end of the pressing portion 2*b* under the principle of the lever with the fulcrum Y connected to the fixing portion 2*c* served as the fulcrum of the lever among the raising portion 2*a*, the pressing portion 2*b* and the fixing portion 2*c*. Since the reaction from that portion of the remaining part causes the fixing portion 2*c* to apply a large upward pulling force to an inner side of the shear-start portion 3*a* of the detachable part 1*a*, an extremely large shearing force acts on the shear-start portion 3*a* of the shearing line to start shearing at the shear-start portion.

The provision of the bend-supporting portion 8 can separate the raising force into a force required for initial raising operation of the pull tab 2 and a force required for initial opening operation of the upper panel 1, and only the bend-supporting portion 8, which is made of a single aluminum plate, is bent during a time period from the moment the finger is put against the pull tab from the time a sufficient space is created for engagement of the fingertip. As a result, the initial raising operation of the pull tab 2 can be sufficiently carried out with a quite small force, preventing the fingertip from being hurt or the fingernail from being chipped.

In the raising operation after having engaged the fingertip with the pull tab in a sufficient manner, it is easy to start opening with a small force because the raising force is amplified by the principle of the lever. In contrast with the prior art, there is no need for the provision of a recess under the raising portion of the upper panel for easy engagement with a fingertip with the raising portion of the pull tab and for easy application of a large raising force to the pull tab, and processing such as bending the raising portion in a C-character shape in section with an opening formed at a lower side in order to prevent a fingertip from being hurt or a fingernail tip from being chipped in application of a large raising force.

The pull tab can be easily raised even by a hardly movable finger such as a finger numbed with cold in winter fishing or skiing, a wet finger and a gloved finger to open the container.

When the detachable part 1*a* of the upper panel has a recess formed thereon at a position corresponding to the raising portion of the pull tab, or the raising portion 2 has an edge curled, the advantages offered by the present invention are promoted.

In this embodiment, the pull tab 2 is formed with the fixing portion 2*c* defined by the cut substantially in a U-character shape, and the pull tab is fixed to the upper panel at the fixing portion. Even if a downward external force is applied to the raising portion 2*a* of the pull tab floated above the upper panel 1 by the ribs 5, the external force can be absorbed into the bend-supporting portion 8 to prevent the fixing portion 2*c* from applying an upward pulling force to the upper panel, offering an advantage in that inadvertent opening is avoided.

In FIG. 6(*a*), reference numeral 9 designates a projection which is provided on the pull tab at a position near to the pressing portion 2*b* than the bend-supporting portion 8. As an example, the projection 9 is extended toward the upper panel 1 by forming a depression 9' in the vicinity of the bend-supporting portion 8. The depression 9' is the deepest at a position adjacent the bend-supporting portion 8, and the depression has a slanted lower surface extended to the substantially same level as the lower surface of the pressing portion 2*b*. The depression has a riser wall adjacent to the bend-supporting portion 8 oriented substantially vertically to the surface of the pull tab 2.

When the pull tab 2 is raised to such an extent that a fingertip can be sufficiently engaged with the raising portion 2*a* of the pull tab 2, and the bend-supporting portion 8 is raised to be oriented vertically to the pull tab, the projection 9 gets in touch with a lower surface of the bend-supporting portion 8. While the pull tab is further raised, the projection can keep the angle defined between the pull tab 2 and the bend-supporting portion 8 at right angles to prevent the pressing portion 2*b* from tottering in the swingable direction with respect to the fixing portion 2*c*, thereby stabilizing the raising operation for the pull tab.

As explained, the provision of the projection 9 near to the bend-supporting portion 8 allows the riser wall of the projection 9 to get in touch with the lower surface of the raised bend-supporting portion 8, and supports the bend-supporting portion 8 as the fulcrum of the lever to enhance the mechanical strength of the bend-supporting portion when the raising portion 2*a* is raised as shown in FIGS. 6(*c*) and (*d*). As a result, the swingable direction of the pressing portion 2*b* can be prevented from tottering with respect to the fixing portion 2*c* during subsequent pull tab raising operation, carrying out the opening operation in an extremely stable manner.

When a rib 1*d* (or a groove) is formed on the remaining part 1*b* of the upper panel on a line connecting between the rivet 1*c* and the leading edge of the pressing portion 2*b* of the pull tab, and a recess 2*d* (or convex) is formed on the leading end of the pressing portion to correspond to the rib (or the groove) in this embodiment like the previous embodiment, the stability of the raising operation can be further improved.

Obviously, numerous modifications and variations of the present invention are possible in light of the above teachings. It is therefore to be understood that within the scope of the appended claims, the invention may be practiced otherwise than as specifically-described herein.

What is claimed is:

1. A container opening device comprising:

an upper panel and a pull tab;

the upper panel having a shearing line including a shear-start portion, linear portions extending from opposite ends of the shear-start portion in an equal length, and an arced portion connecting leading edges of the linear portions so as to provide a detachable portion surrounded by the shearing line;

foldable lines formed on the detachable portion, each being located at a position inner to and in parallel to each of the linear portions;

ribs formed on the detachable portion, each extending at a position near to and in parallel to each of the foldable lines;

the pull tab having one end formed with a raising portion, the other end formed with a pressing portion and an intermediate portion formed with a fixing portion;

the fixing portion fixed to the detachable portion of the upper panel at a position inner to the shear-start portion; and the pressing portion extending out of the shearing line so as to press a portion of a remaining portion of the upper panel located outside of the shear-start portion when the raising portion is raised.

2. A container opening device according to claim 1, wherein the shear-start portion of the shearing line is formed at a position near to a portion of an outer periphery of the upper panel, each of the linear portions extends from each of the opposite ends of the shear-start portion to a position nearest to another portion of the outer periphery of the upper panel, and the arced portion extends along the outer periphery of the upper panel at a position nearest to the other portion of the outer periphery of the upper panel.

3. A container opening device according to claim 1, wherein the fixing portion of the pull tab is formed in a tongue shape which is defined by a cut or a notch in a substantially U-character shape so as to extend from the pressing portion of the pull tab in a direction toward the raising portion, the fixing portion having a base end formed with a bend-supporting portion; and the bend-supporting portion providing a space for insertion of a finger between the upper panel and the raising portion of the pull tab, which is upwardly bent and up raised by a initial raising force applied to the raising portion;

wherein when a raising force is applied to the raising portion subsequently to the initial raising force, the subsequent raising force is amplified under a principle of a lever with the raising portion, the pressing portion for pressing the upper panel and the fixing portion served respectively as an input point, a fulcrum and an output point so that the pulling force is transmitted from the fixing portion to a position inner to the shear-start portion of the detachable portion of the upper panel as a large pulling force.

4. A container opening device according to claim 3, wherein the pull tab has a projection formed thereon between the pressing portion and the bend-supporting portion of the pull tab so as to downwardly project and to get in close touch with the bend-supporting portion, which is upraised by raising the pull tab.

5. A container opening device according to claim 1, wherein a notch is formed between the shear-start portion and each of the linear portions of the shearing line so as to reach a start-end of each of the foldable lines.

* * * * *